US007803033B1

(12) United States Patent
Walterscheid

(10) Patent No.: US 7,803,033 B1
(45) Date of Patent: Sep. 28, 2010

(54) POP ACTION TOY

(76) Inventor: Steve Walterscheid, P.O. Box 7409, Bend, OR (US) 97708

( * ) Notice: Subject to any disclaimer, the term of this patent is extended or adjusted under 35 U.S.C. 154(b) by 257 days.

(21) Appl. No.: 11/879,713

(22) Filed: Jul. 19, 2007

(51) Int. Cl.
*A63H 33/00* (2006.01)

(52) U.S. Cl. ..... 446/486; 446/308; 473/569; D21/436

(58) Field of Classification Search ..... 446/4, 446/308, 473, 486; 473/604, 579, 569; 273/317.5, 273/428; D21/398, 405, 436, 711, 713
See application file for complete search history.

(56) References Cited

U.S. PATENT DOCUMENTS 1,676,296 A * 7/1928 Spencer ..... 446/14
2,153,957 A * 4/1939 Davis ..... 446/486
5,213,538 A * 5/1993 Willett ..... 446/4
D355,231 S * 2/1995 Chien ..... D21/711
D527,427 S * 8/2006 Andersen ..... D21/398
7,335,085 B2 * 2/2008 Lyman ..... 446/486

* cited by examiner

*Primary Examiner*—Gene Kim
*Assistant Examiner*—Scott Young
(74) *Attorney, Agent, or Firm*—LaMorte & Associates

(57) ABSTRACT

A pop action toy assembly having an elastomeric body that is defined primarily by a first surface and a second surface. The elastomeric body is selectively positionable between a normal orientation, where the first surface faces outwardly, and an inverted orientation, where the second surface faces outwardly. An activator assembly having an impact disc and a knob extends through the elastomeric body at its apex. The impact disc strikes the ground when the toy assembly pops from an inverted orientation back into its normal orientation. The knob is used to grasp, spin and throw the toy assembly when inverted. A plurality of tabs symmetrically protrude from the base rim of the elastomeric body. If the toy assembly is inverted and strikes the ground, the protruding tabs act to concentrate the force of the impact and cause the toy assembly to pop back into its normal orientation.

18 Claims, 5 Drawing Sheets

POP ACTION TOY

BACKGROUND OF THE INVENTION

1. Field of the Invention

In general, the present invention relates to toys that are spring loaded and pop up into the air when activated. More particularly, the present invention relates to toys that contain a hemispherical structure that is inverted to store the spring energy needed to pop the toy into the air.

2. Prior Art Description

Rubber balls have been commercially manufactured for well over a century. The original rubber balls were made from two hemispherical pieces of rubber that were glued together to form the shape of the ball. As the balls were played with, it was not uncommon for the two halves of the ball to separate. A child, playing with the ball would then have two half balls. Half-balls were so common that many childhood games required the use of a "half ball".

One game played with a half ball to invert the half ball so that it would pop. When a half ball is inverted it stores energy like a spring. If the inverted ball were dropped or touched, the half ball would pop back into its hemispherical shape, thereby releasing the stored energy. The popping action of the half ball would cause the half ball to fly up into the air.

Recognizing the play value of half balls, toy manufacturers began to manufacture half balls and configure the half balls to optimize the popping action. Such half balls are exemplified by U.S. Pat. No. 2,153,957 to Davis, entitled Jumping ball, which was patented in 1938. In more modern times, secondary objects, such as dolls and superheroes have been attached to half balls. In this manner, when the half ball pops and flies into the air, so does the toy character. Half balls that carry secondary characters are exemplified by U.S. Pat. No. 5,213,538 to Willett, entitled Pop-Action Bouncing Doll.

Half ball popping toys have certain problems that are inherent with their design. If a half ball is made from a material that is too thick or has too high a durometer, then the half ball will not remain inverted for long. As soon as the half ball is inverted, the half ball begins to bend back toward its original hemispherical shape. The half ball will therefore pop back into its hemispherical shape only a few moments after it is inverted. If a half ball is made too thin or with a material that has too low a durometer, then the half ball will not store much energy when it is inverted. The half ball will, therefore, not pop back into its original hemispherical shape with much energy and the toy will not pop into the air.

To avoid these problems, toy manufacturers usually balance material thickness and durometer to create a half ball that remains in an inverted shape indefinitely, yet stores enough energy to actively pop once triggered. In order to trigger the inverted half ball, the half ball must be dropped or momentarily pressed. Pressing an inverted half ball is problematic, seeing that the hand used to press the inverted half ball usually gets in the way of the half ball when it suddenly pops. Dropping a half ball is equally problematic, seeing that the half ball will only activate if it strike the ground flush on its base or upon its apex. If the half ball strikes the ground at an angle, the energy of the impact does not act to change the configuration of the half ball and the half ball remains inverted.

A need therefore exists for a half ball configuration that can be set into an inverted position indefinitely, yet can be caused to pop back into its original hemispherical shape with far more consistency and predictability than is available in the prior art. This need is met by the present invention as described and claimed below.

SUMMARY OF THE INVENTION

The present invention is a pop action toy assembly. The pop action toy assembly has an elastomeric body that is defined primarily by a first surface and a second surface. Both the first surface and the second surface converge from a wide base rim to a central apex. The elastomeric body is selectively positionable between a normal orientation, where the first surface faces outwardly, and an inverted orientation, where the second surface faces outwardly.

An activator assembly extends through the elastomeric body at the central apex. The activator assembly provides an impact disc of a first diameter that extends beyond the first surface of the elastomeric body and a knob that extends beyond the second surface of the elastomeric body. The impact disc strikes the ground when the toy assembly pops from an inverted orientation back into its normal orientation. The knob is used to grasp, spin and throw the toy assembly. A plurality of tabs symmetrically protrude from the base rim of the elastomeric body. If the toy assembly is inverted and strikes the ground, the protruding tabs act to concentrate the force of the impact and cause the toy assembly to pop back into its normal orientation.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Figure 1:
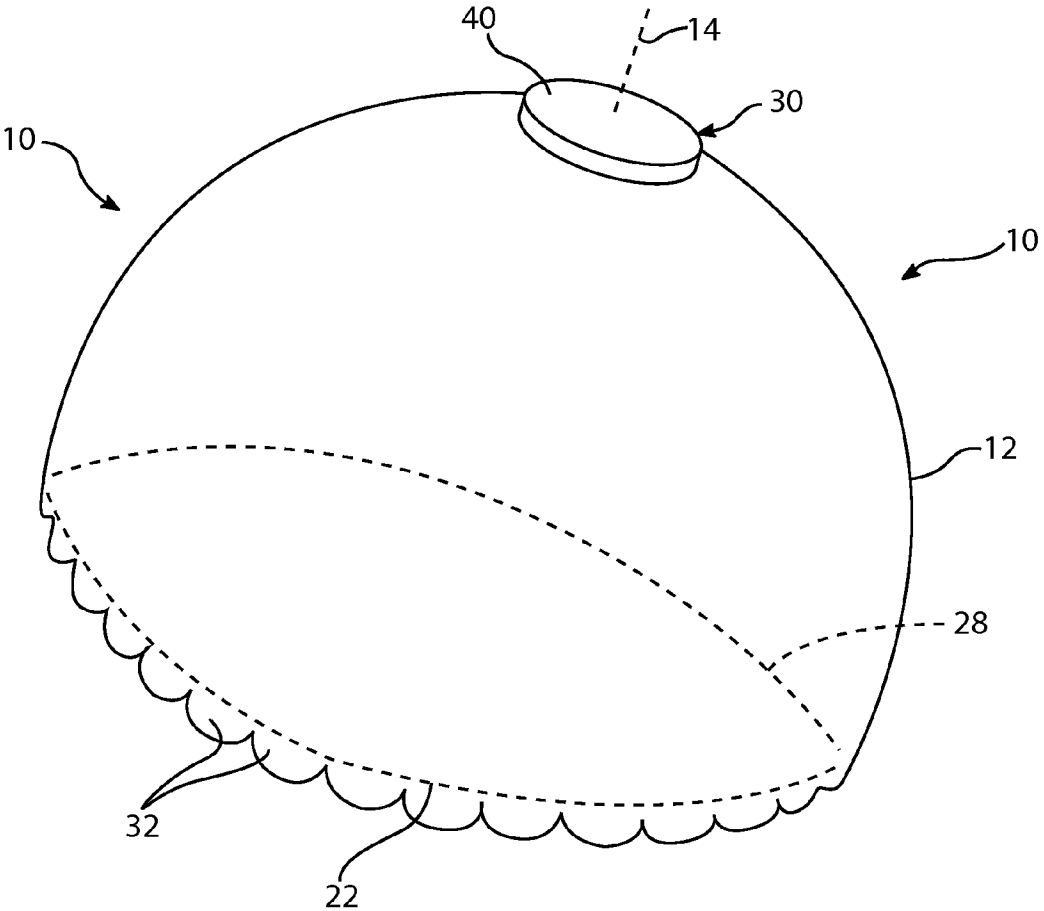
FIG. 1 is a perspective view of an exemplary embodiment of a pop action toy assembly in its normal configuration.
Figure 2:
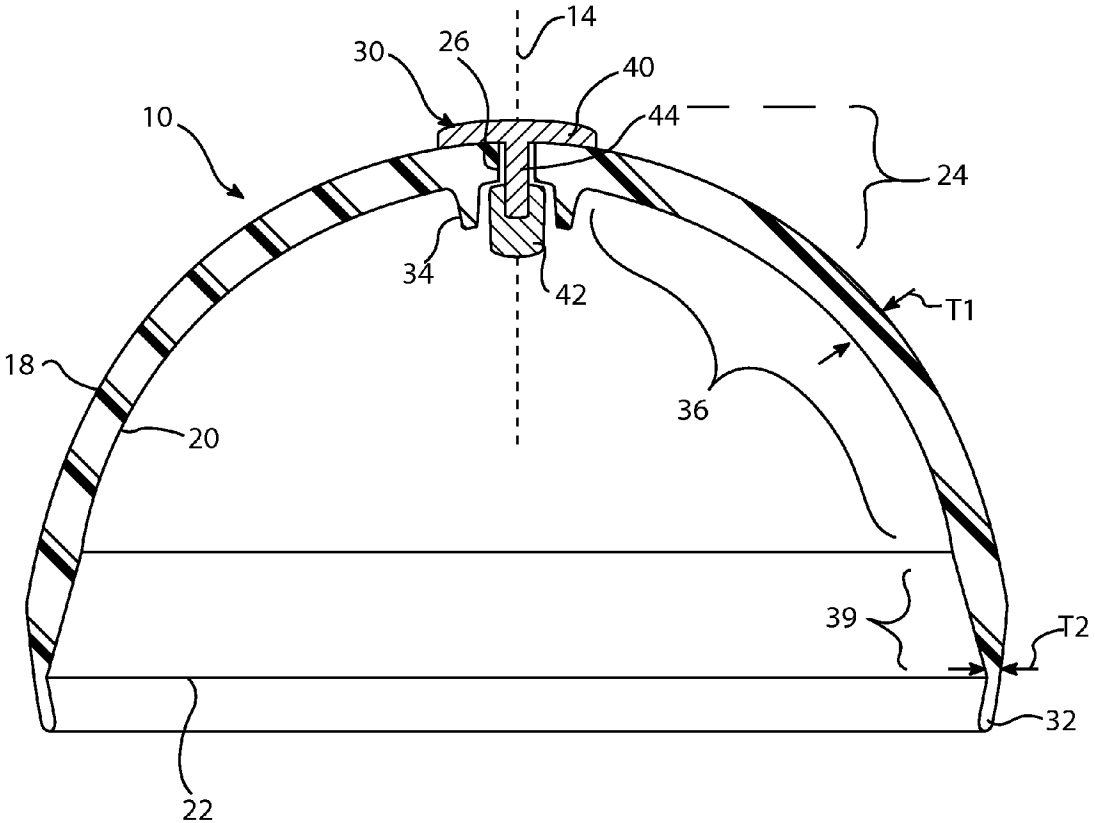
FIG. 2 is a cross-sectional view of the embodiment of FIG. 1.

Referring to FIG. 1 in conjunction with FIG. 2, a pop action toy 10 is shown in its normal configuration. The pop action toy 10 has a half ball body 12 that is symmetrically disposed around an imaginary vertical mid-axis 14. The half ball body 12 is made of a highly elastomeric material, such as rubber or a synthetic rubber. The half ball body 12 is defined primarily by a first surface 18 and a second surface 20. The first surface 18 and second surface 20 both converge from a wide base rim 22 toward a central apex region 24. When the half ball body 12 is in its normal configuration, as is shown in FIG. 1, the first surface 18 is the exterior surface of the half ball body 12.

An aperture 26 is formed in the apex region 24 of the half ball body 12 along the mid-axis 14. The aperture 26 holds an activator assembly 30, the structure and function of which will be later explained.

The base rim 22 of the half ball body 12 exists in a rim plane 28 that is perpendicular to the mid-axis 14. The first surface 18 of the half ball body 12 is hemispherical in shape, having a consistent radius from the apex region 24 down to the rim plane 28. Accordingly, the first surface 18 of the half ball body 12 is smooth and rounded. A plurality of protruding tabs 32 extend down from the half ball body 12 below the rim plane 28. The protruding tabs 32 are symmetrically dispersed around the base rim 22 and lay in the vertical plane, parallel to the mid-axis 14. As will later be described, the protruding tabs 32 are used to help the pop action toy 10 pop from an inverted configuration into the shown normal configuration.

The second surface 20 of the half ball body 12 is complex. When the half ball body 12 is in its normal configuration, as is shown, the second surface 20 is the interior surface of the half ball body 12. A cylindrical wall 34 extends downwardly from the second surface 20 in the apex region 24. The cylindrical wall 34 encircles a portion of the activator assembly 30. A uniform section 36 of the second surface 20 extends from the base of the cylindrical wall 34 to a transition plane 38. The transition plane 38 lay approximately two-thirds of the way down the half ball body 12. In the uniform section 36, the half ball body 12 has a uniform thickness T1. Below the transition plane 38, the half ball body 12 enters a tapered section 39 and begins to thin. The thickness of the half ball body 12 thins between 30% and 60%, from a first thickness at the transition plane 38 to a thinner second thickness T2 at the rim plane 28. The protruding tabs 32 maintain the second thickness along their lengths.

The activator assembly 30 includes both an enlarged impact disc 40 and a knurled knob 42. The impact disc 40 is attached to the knurled knob 42 by a shaft 44. The shaft 44 extends through the aperture 26 in the apex region 24 of the half ball body 12. Consequently, when the pop action toy 10 is in its normal configuration, the impact disc 40 extends beyond the first surface 18 of the half ball body 12 and the knurled knob 42 extends below the second surface 20 of the half ball body 12. The knurled knob 42 has a diameter that enables the knurled knob 42 to pass into the area defined by the cylindrical wall 34. The impact disc 40 is bigger, having a diameter that is slightly larger than the maximum diameter of the cylindrical wall 34.

Figure 3:
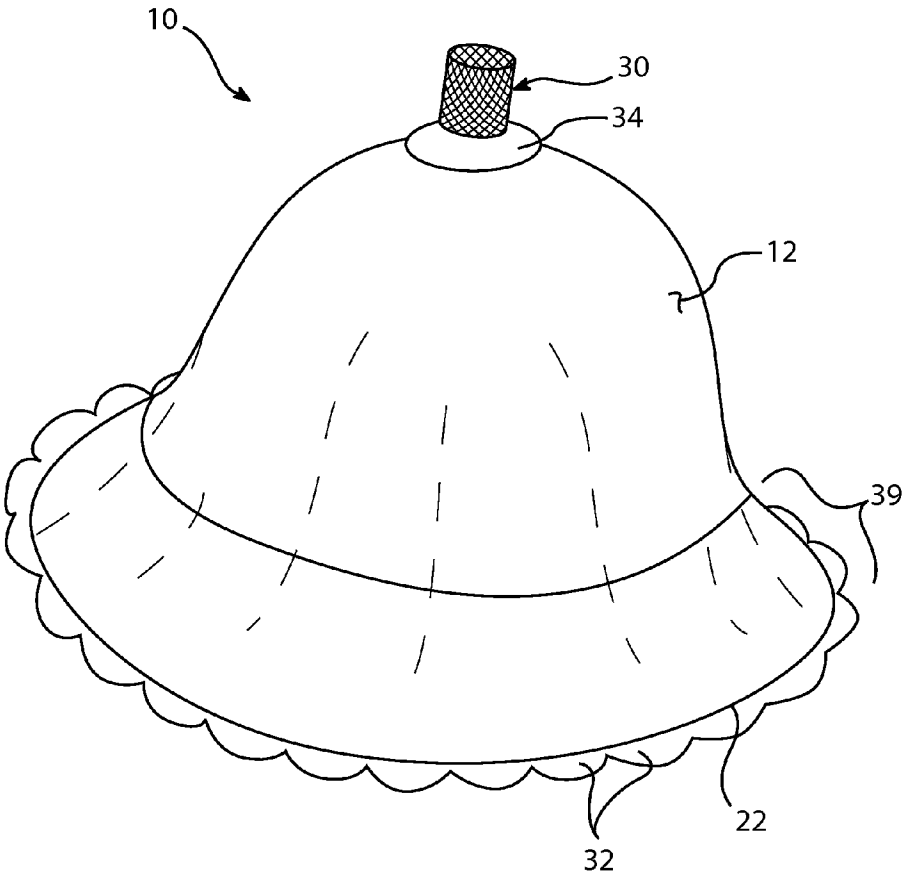
FIG. 3 is a perspective view of an exemplary embodiment of a pop action toy assembly in its inverted configuration.
Figure 4:
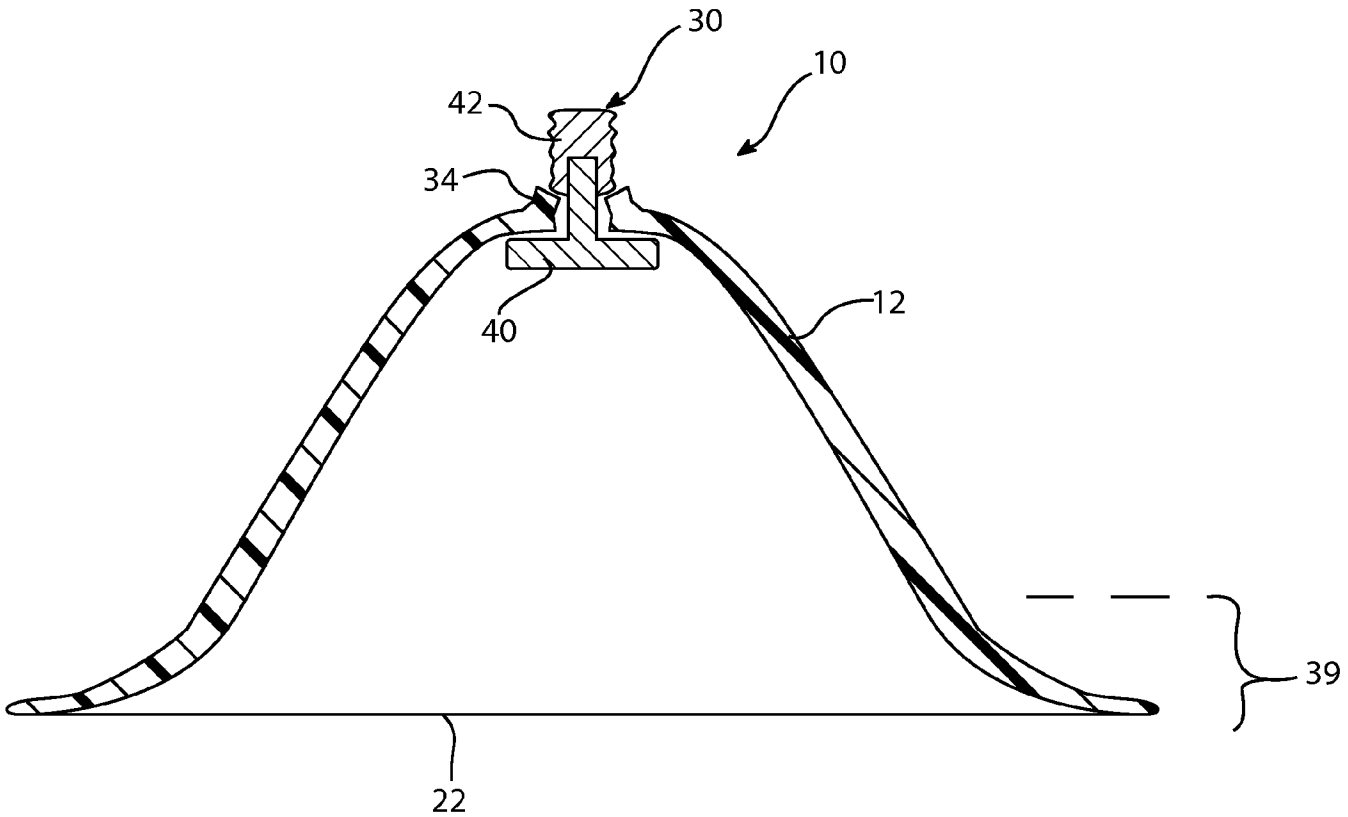
FIG. 4 is a cross-sectional view of the embodiment of FIG. 3.

Referring to FIG. 3 in conjunction with FIG. 4, it can be seen that the half ball body 12 of the pop action toy 10 can be inverted. When the half ball body 12 is inverted, the half ball body 12 bends around the impact disc 40 of the activator assembly 30. Since the impact disc 40 has a diameter that is larger than the cylindrical wall 34, the cylindrical wall 34 must stretch to invert. The cylindrical wall 34, therefore, loses its cylindrical shape and becomes frustum shaped. The altering of the cylindrical wall 34 has two effects. First, the cylindrical wall 34 shortens as it stretches into the frustum shape. This exposes the knurled knob 42. Secondly, as the cylindrical wall 34 stretches, it adds significantly to the spring energy that is stored within the inverted half ball body 12.

When the half ball body 12 is inverted, the uniform section 36 of the second surface 20 follows a first tonic curvature. However, the tapered section 39, being less thick, deforms more readily and curves into the horizontal plane. Accordingly, the protruding tabs 32 that extend from the half ball body 12 extend primarily in a horizontal direction. It will therefore be understood that if the pop action toy 10 is placed upon a flat surface, while inverted, the second surface 20 immediately proximate the base rim 22 would be in contact with that flat surface. The area in contact or near contact with the ground increases dramatically by the presence of the protruding tabs 32.

When the half ball body 12 is inverted, the knurled knob 42 extends upwardly at the top of the pop action toy 10. The knurled knob 42 can be readily grasped by the hand of a person. Utilizing the knurled knob 42, a person can rotate the entire pop action toy 10 like a top. If the inverted pop action toy 10 is thrown as it is spun, the spinning action stabilizes the pop action toy 10 in flight. The pop action toy 10 sails through the air like a flying disc, i.e. Frisbee®. When the inverted pop action toy 10 lands, its stable flight orientation causes the wide base rim 22 to contact the ground first.

Any upward contact to the wide base rim 22 of the inverted half ball body 12 acts to cause the half ball body 12 to pop back into its original shape. Accordingly, if the pop action toy 10 is inverted and is dropped to the ground at any height greater than a few inches, the force of the impact with the ground will cause the inverted half ball body 12 to instantly pop back into its original hemispherical shape. The pop action is particularly sensitive to contact with the protruding tabs 32. Since the protruding tabs 32 are periodically spaced around the periphery of the half ball body 12, it will be understood that one of the protruding tabs 32 is likely to strike the ground first if the pop action toy 10 strikes the ground slightly off kilter. An impact on one of the protruding tabs 32 concentrates the force of the impact into the small shape of the protruding tab 32. Consequently, only a small impact force will cause the inverted half ball body 12 to pop back into its original hemispherical shape.

Figure 5:
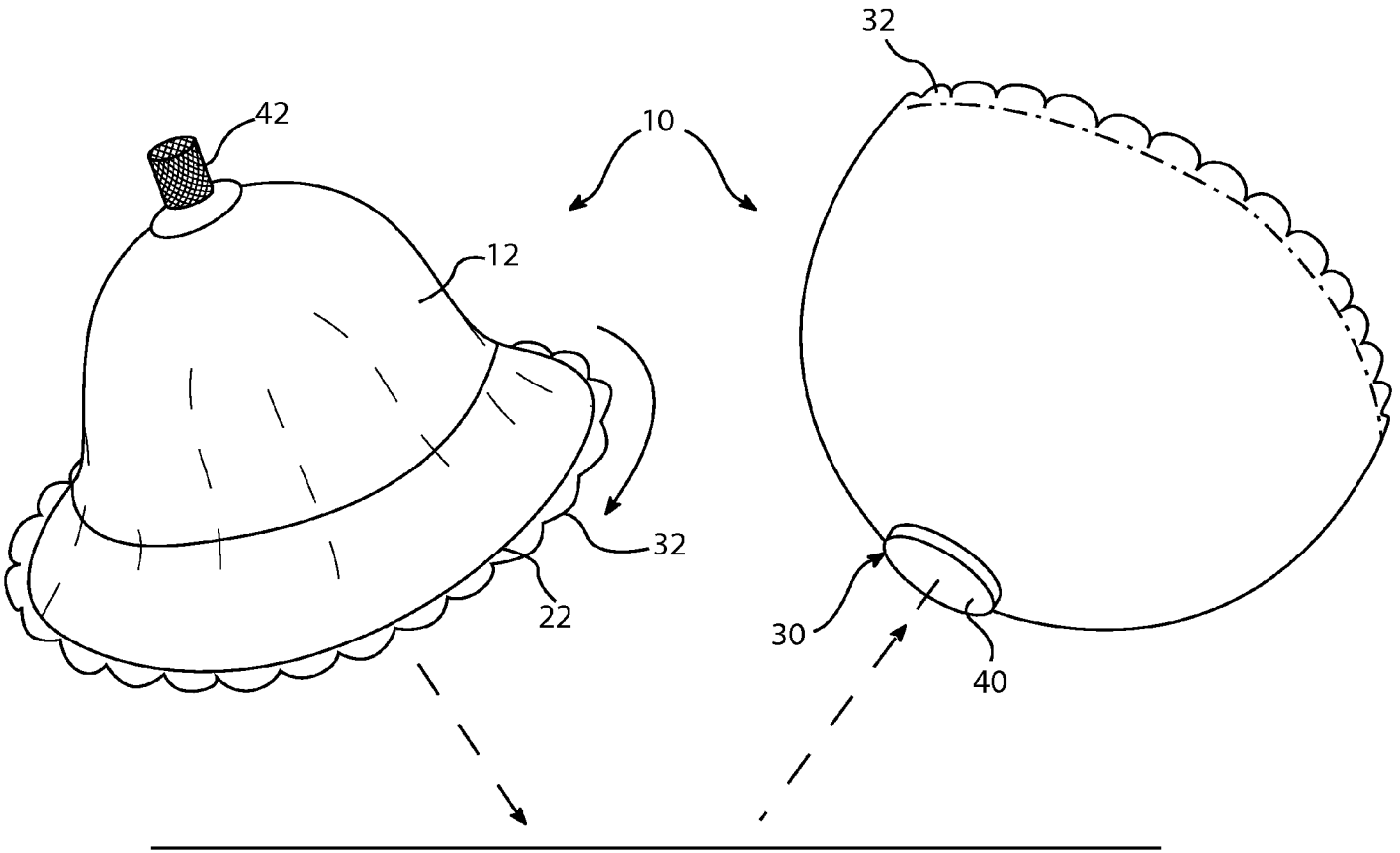
FIG. 5 illustrates the rebounding action of the pop action toy assembly as it pops from an inverted configuration back into a normal configuration.

Referring to FIG. 5, in conjunction with FIGS. 2 and 4, it will be understood that to utilize the pop action toy 10, the half ball body 12 is manually manipulated into its inverted configuration. A user then can grasp the knurled knob 42. Using the knurled knob 42, a person spins and throws the inverted pop action toy 10. The inverted pop action toy 10 flies through the air and eventually strikes the ground. At the moment of impact, a protruding tab 32 or another part of the wide base rim 22 strikes the ground. The force of the impact causes the inverted half ball body 12 to immediately convert back to its original hemispherical shape. At the moment of conversion, the energy stored in the inverted half ball body 12 is released. The stored energy causes the impact disc 40 of the activator assembly 30 to be driven downwardly and strike the ground. The reaction force supplies an upward force to the pop action toy 10. The pop action toy 10 will therefore rebound off the ground with great energy. Preferably, the energy utilized for the rebound causes the pop action toy 10 to fly up into the air to a height of between three and ten feet. The pop action toy 10 will therefore "bounce" up off the ground when dropped, often to a height greater than from where it was dropped.

It will be understood that the embodiment of the present invention that is illustrated and described is merely exemplary and that a person skilled in the art can make many variations to that exemplary embodiment. For instance, the number, shape and size of the protruding tabs can be varied. The shape and size of the enlarged disc and knurled knob can also be varied. All such variations, modifications and alternate embodiments are intended to be included within the scope of the present invention as defined by the claims.

What is claimed is:

1. A pop action toy assembly, comprising:

an elastomeric body having a first surface and a second surface, said elastomeric body being symmetrically disposed around a mid-axis, wherein said first surface and said second surface both converge from a wide base rim to a central apex, wherein said base rim exists in a base plane that is perpendicular to said mid-axis, wherein a transitional plane exits between said base rim and said central apex that is parallel to said base plane, wherein said elastomeric body tapers in thickness between said first surface and said second surface, from a first thickness at said base rim to a second larger thickness at said transition plane, wherein said elastomeric body is selectively positionable between a normal orientation, where said first surface faces outwardly, and an inverted orientation, where said second surface faces outwardly, wherein said elastic body is deformed and stores energy when in said inverted orientation;

an activator extending through said elastomeric body at said central apex, said activator having a disc of a first diameter extending beyond said first surface of said elastomeric body and a knob extending beyond said second surface of said elastomeric body; and a plurality of tabs symmetrically extending from said base rim of said elastomeric body, wherein said plurality of tabs extend in a first plane when said elastomeric body is in said normal orientation and change into a second plane that is generally perpendicular to said first plane when said elastomeric body is converted into said inverted orientation.

2. The assembly according to claim 1, wherein said first surface is hemispherical in shape when said elastomeric body is in said normal orientation.

3. The assembly according to claim 1, wherein said elastomeric body has a uniform thickness between said first surface and said second surface from said transition plane toward said central apex.

4. The assembly according to claim 3, further including an elastomeric cylindrical wall extending from said second surface proximate said central apex.

5. The assembly according to claim 4, wherein said cylindrical wall encircles said knob of said activator.

6. The assembly according to claim 5, wherein said cylindrical wall has a diameter smaller than said first diameter of said disc of said activator.

7. The assembly according to claim 1, wherein said disc is the highest part of said pop action toy when said elastomeric body is in said normal orientation and resting upon said base rim.

8. The assembly according to claim 7, wherein said knob is the highest part of said pop action toy when said elastomeric body is in said inverted orientation and resting upon said base rim.

9. The assembly according to claim 1 further including a plurality of tabs symmetrically extending from said base rim of said elastomeric body.

10. A pop action toy assembly, comprising:

an elastomeric body having a first surface and a second surface, wherein said first surface and said second surface both converge from a wide base rim to an central apex, wherein said elastomeric body is selectively positionable between a normal orientation, where said first surface faces outwardly, and an inverted orientation, where said second surface faces outwardly, wherein said elastomeric body is deformed and stores energy when in said inverted orientation;

an impact disc extending beyond said first surface at said central apex, wherein said impact disc is the highest part of said pop action toy when said elastomeric body is in said normal orientation and resting upon said base rim;

a spin knob extending beyond said second surface at said central apex, wherein said spin knob is the highest part of said pop action toy when said elastomeric body is in said inverted orientation and resting upon said base rim; and a plurality of tabs symmetrically extending from said base rim of said elastomeric body, wherein said plurality of tabs extend in a first plane when said elastomeric body is in said normal orientation and change into a second plane that is generally perpendicular to said first plane when said elastomeric body is converted into said inverted orientation.

11. The assembly according to claim 10, wherein said spin knob and said impact disc are interconnected through a hole in said elastomeric body.

12. The assembly according to claim 10, further including tabs that extend from said base rim of said elastomeric body.

13. The assembly according to claim 10, wherein said first surface is hemispherical in shape when said elastomeric body is in said normal orientation.

14. The assembly according to claim 10, wherein said elastomeric body tapers in thickness between said first surface and said second surface, from a first thickness at said base rim to a second larger thickness at a transition plane between said base rim and said central apex.

15. The assembly according to claim 14, wherein said elastomeric body has a uniform thickness between said first surface and said second surface from said transition plane toward said central apex.

16. The assembly according to claim 15, further including an elastomeric cylindrical wall extending from said second surface proximate said central apex.

17. The assembly according to claim 16, wherein said cylindrical wall encircles said spin knob.

18. The assembly according to claim 17, wherein said cylindrical wall has a diameter smaller than said impact disc.

* * * * *